US012673842B2

(12) United States Patent
Kanehagi et al.

(10) Patent No.: US 12,673,842 B2
(45) Date of Patent: Jul. 7, 2026

(54) FIBER PACKAGE

(71) Applicant: Mitsubishi Chemical Corporation, Tokyo (JP)

(72) Inventors: Junji Kanehagi, Tokyo (JP); Yukihiro Mizutori, Tokyo (JP)

(73) Assignee: Mitsubishi Chemical Corporation, Tokyo (JP)

( * ) Notice: Subject to any disclaimer, the term of this patent is extended or adjusted under 35 U.S.C. 154(b) by 1228 days.

(21) Appl. No.: 17/383,838

(22) Filed: Jul. 23, 2021

(65) Prior Publication Data

US 2021/0347600 A1 Nov. 11, 2021

Related U.S. Application Data

(63) Continuation of application No. PCT/JP2020/001851, filed on Jan. 21, 2020.

(30) Foreign Application Priority Data

Jan. 28, 2019 (JP) ..... 2019-011966

(51) Int. Cl.
*B65H 54/06* (2006.01)
*B65H 54/28* (2006.01)
(Continued)

(52) U.S. Cl.
CPC ..... *B65H 54/06* (2013.01); *B65H 54/28* (2013.01); *B65H 55/04* (2013.01); *D02J 1/18* (2013.01); *B65H 2701/314* (2013.01)

(58) Field of Classification Search
CPC ..... B65H 54/06
See application file for complete search history.

(56) References Cited

U.S. PATENT DOCUMENTS 4,586,679 A * 5/1986 Yamamoto ..... B65H 55/04 242/176
6,276,624 B1 * 8/2001 Endo ..... B65H 55/04 242/174

(Continued)

FOREIGN PATENT DOCUMENTS

CN 107848146 A 3/2018
CN 109312502 A 2/2019

(Continued)

OTHER PUBLICATIONS

Office Action issued Mar. 27, 2024 for U.S. Appl. No. 17/865,288.

(Continued)

*Primary Examiner* — Andrew T Piziali
(74) *Attorney, Agent, or Firm* — Morgan, Lewis & Bockius LLP

(57) ABSTRACT

An object of the present invention is to provide a fiber package in which a partially split carbon fiber bundle is wound around a bobbin, and which has no problem in unwindability. A fiber package is provided, which is a square-end type fiber package formed by traverse winding a fiber bundle (12) around a bobbin, in which the fiber bundle (12) is partially split into sub-bundles (11), and the width W of the fiber bundle (12) is smaller than the total sum of the widths $W_S$ of the sub-bundles (12). A fiber package is also provided, which is a square end type fiber package formed by traverse winding a fiber bundle (12) around a bobbin, in which the fiber bundle (12) is partially split into sub-bundles (11) and is wound around the bobbin so as to cause the sub-bundles (11) to overlap each other.

19 Claims, 3 Drawing Sheets

(51) Int. Cl.
*B65H 55/04* (2006.01)
*D02J 1/18* (2006.01)

(56) References Cited

U.S. PATENT DOCUMENTS

| | | | | |
|---|---|---|---|---|
| 6,385,828 | B1 | 5/2002 | Kiss et al. | |
| 2006/0053593 | A1* | 3/2006 | Gombash, Jr. | D01G 7/00 19/66 T |
| 2009/0314870 | A1 | 12/2009 | Kiriyama et al. | |
| 2012/0213997 | A1 | 8/2012 | Wang et al. | |
| 2017/0355550 | A1 | 12/2017 | Kawahara et al. | |
| 2018/0194082 | A1 | 7/2018 | Samejima et al. | |
| 2019/0161890 | A1 | 5/2019 | Motohashi et al. | |
| 2019/0177887 | A1 | 6/2019 | Motohashi et al. | |
| 2020/0277455 | A1 | 9/2020 | Kanehagi et al. | |
| 2021/0032067 | A1 | 2/2021 | Kuroda et al. | |
| 2021/0347600 | A1 | 11/2021 | Kanehagi et al. | |

FOREIGN PATENT DOCUMENTS

| | | | |
|---|---|---|---|
| EP | 0835953 | A2 | 4/1998 |
| EP | 3395526 | A1 | 10/2018 |
| EP | 3395551 | A1 | 10/2018 |
| JP | S62-046468 | B2 | 10/1987 |
| JP | H07-257818 | A | 10/1995 |
| JP | H09-012220 | A | 1/1997 |
| JP | H10-316311 | A | 12/1998 |
| JP | 2007-092218 | A | 4/2007 |
| JP | 2009-221017 | A1 | 10/2009 |
| JP | 2010-001597 | A | 1/2010 |
| JP | 2010-163536 | A | 7/2010 |
| JP | 2017-177522 | A | 10/2017 |
| RU | 2289507 | C2 | 12/2006 |
| WO | 2008/029740 | A1 | 3/2008 |
| WO | 2016/104154 | A1 | 6/2016 |
| WO | 2017/006989 | A1 | 1/2017 |
| WO | 2017/111056 | A1 | 6/2017 |
| WO | 2017/221655 | A1 | 12/2017 |
| WO | 2017/221688 | A1 | 12/2017 |
| WO | 2019/098370 | A1 | 5/2019 |
| WO | 2019/151076 | A1 | 8/2019 |
| WO | 2020/158496 | A1 | 8/2020 |

OTHER PUBLICATIONS

Extended European Search Report issued in related European Patent Application No. 21744794.5 dated Jun. 23, 2023.

Office Action issued in related Taiwan Patent Application No. 110102139 dated Sep. 21, 2022.

International Search Report issued in related International Patent Application No. PCT/JP2020/001851 dated Mar. 24, 2020.

Third Party Observation filed in related International Patent Application No. PCT/JP2020/001851 dated May 7, 2021.

International Search Report issued in related International Patent Application No. PCT/JP2021/001014 dated Apr. 13, 2021.

Office Action issued in related Chinese Patent Application No. 202080011105.0 dated Jun. 29, 2022.

Extended European Search Report issued Feb. 20, 2024 for European Patent Application No. 23206395.8.

Office Action issued in corresponding Taiwanese Patent Application No. 110102139 dated Jan. 25, 2022.

Extended European Search Report issued in corresponding European Patent Application No. 20748420.5 dated Feb. 17, 2022.

Office Action issued Mar. 18, 2024 for Chinese Patent Application No. 202180009443.5.

Notification of Third Party Submission issued in corresponding Japanese Patent Application No. 2020-569525 dated Dec. 7, 2021.

* cited by examiner

FIBER PACKAGE

This application is a continuation application of International Application No. PCT/JP2020/001851, filed on Jan. 21, 2020, which claims the benefit of priority of the prior Japanese Patent Application No. 2019-011966 filed on Jan. 28, 2019 in Japan, the content of which is incorporated herein by reference.

TECHNICAL FIELD

The present invention relates to a fiber package.

BACKGROUND ART

Patent Document 1 discloses a square end type carbon fiber package in which a carbon fiber bundle having a fineness of 25,000 to 35,000 denier is wound on a bobbin at a lead angle at the winding start of 13° to 14°, and a lead angle at the winding end of 3° or more, by setting the fraction after the decimal point of the winding ratio to 0.07 to 0.08.

In Patent Document 2, it is described that a carbon fiber bundle drawn out from a bobbin is widened, further split partially into two sub-bundles, and then wound around another bobbin to form a fiber package, and a sheet molding compound (SMC) is produced by feeding out the carbon fiber bundle from that fiber package.

CITATION LIST

Patent Documents

[Patent Document 1]
PCT International Publication No. WO 2008/029740
[Patent Document 2]
PCT International Publication No. WO 2017/111056

SUMMARY OF INVENTION

Technical Problem

An object of the present invention is to provide a fiber package in which a partially split carbon fiber bundle is wound around a bobbin, and which has no problem in unwindability.

Solution to Problem

The present invention has the following configurations.

[1] A fiber package, which is a square end type fiber package formed by traverse winding a carbon fiber bundle around a bobbin, in which the carbon fiber bundle is partially split into sub-bundles, and a width of the carbon fiber bundle is smaller than a total sum of widths of the sub-bundles.

[2] A fiber package, which is a square end type fiber package formed by traverse winding a carbon fiber bundle around a bobbin, in which the carbon fiber bundle is partially split into sub-bundles and is wound around the bobbin so as to cause the sub-bundles to overlap each other.

[3] The fiber package according to [1] or [2], in which the width of the carbon fiber bundle is 90% or less of the total sum of widths of the sub-bundles.

[4] The fiber package according to any one of [1] to [3], in which between sections of the carbon fiber bundle wound around the bobbin in consecutive traverse cycles that are not separated by 5 cycles or more, the positions of center lines are shifted at least by a shift width of 0.8 or more times the width of the carbon fiber bundle.

[5] The fiber package according to [4], in which between sections of the carbon fiber bundle wound around the bobbin in consecutive traverse cycles that are not separated by 5 cycles or more, the positions of center lines are shifted at least by a shift width of 1.0 or more times the width of the carbon fiber bundle.

[6] The fiber package according to [5], in which between sections of the carbon fiber bundle wound around the bobbin in consecutive traverse cycles that are not separated by 5 cycles or more, the positions of center lines are shifted at least by a shift width of 1.3 or more times the width of the carbon fiber bundle.

[7] The fiber package according to any one of [1] to [6], in which the carbon fiber bundle is partially split into three or more sub-bundles.

[8] The fiber package according to any one of [1] to [7], in which the number of filaments of the sub-bundle is 5000 or less.

[9] The fiber package according to any one of [1] to [8], in which the total number of filaments of the carbon fiber bundle is 12000 or more.

[10] A method for producing a square end type fiber package formed by traverse winding a carbon fiber bundle around a bobbin, the method including: a splitting step of partially splitting a carbon fiber bundle into sub-bundles; and a winding step of winding the carbon fiber bundle that has been partially split into the sub-bundles around a bobbin, in which in the winding step, the carbon fiber bundle is wound around the bobbin such that a width of the carbon fiber bundle is smaller than a total sum of widths of the sub-bundles.

[11] A method for producing a square end type fiber package formed by traverse winding a carbon fiber bundle around a bobbin, the method including: a splitting step of partially splitting a carbon fiber bundle into sub-bundles; and a winding step of winding the carbon fiber bundle that has been partially split into the sub-bundles around a bobbin, in which in the winding step, the carbon fiber bundle is wound around the bobbin so as to cause the sub-bundles to overlap each other.

[12] The method for producing a square end type fiber package according to [10] or [11], in which in the winding step, the carbon fiber bundle is wound around the bobbin such that the width of the carbon fiber bundle is 90% or less of the total sum of the widths of the sub-bundles.

[13] The method for producing a square end type fiber package according to any one of [10] to [12], in which in the winding step, between sections of the carbon fiber bundle wound around the bobbin in consecutive traverse cycles that are not separated by 5 cycles or more, the positions of center lines are shifted at least by a shift width of 0.8 or more times the width of the carbon fiber bundle.

[14] The method for producing a square end type fiber package according to [13], in which in the winding step, between sections of the carbon fiber bundle wound around the bobbin in consecutive traverse cycles that are not separated by 5 cycles or more, the positions of center lines are shifted at least by a shift width of 1.0 or more times the width of the carbon fiber bundle.

[15] The method for producing a square end type fiber package according to [14], in which in the winding step, between sections of the carbon fiber bundle wound around the bobbin in consecutive traverse cycles that are not separated by 5 cycles or more, the positions of center lines are shifted at least by a shift width of 1.3 or more times the width of the carbon fiber bundle.

[16] The method for producing a square end type fiber package according to any one of [10] to [15], in which in the splitting step, the carbon fiber bundle is partially split into three or more sub-bundles.

[17] The method for producing a square end type fiber package according to any one of [10] to [16], in which the number of filaments of the sub-bundle is 5000 or less.

[18] The method for producing a square end type fiber package according to any one of [10] to [17], in which the total number of filaments of the carbon fiber bundle is 12000 or more.

Advantageous Effects of Invention

According to the present invention, a fiber package in which a partially split carbon fiber bundle is wound around a bobbin, and which has no problem in unwindability of the carbon fiber bundle, can be provided.

DESCRIPTION OF EMBODIMENTS

1. Carbon Fiber Package and Method for Producing the Same

Hereinafter, a carbon fiber package according to an embodiment of the present invention will be described with reference to the drawings. In the present specification, the carbon fiber package is also simply referred to as a fiber package, and a carbon fiber bundle is also simply referred to as a fiber bundle.

Figure 1:
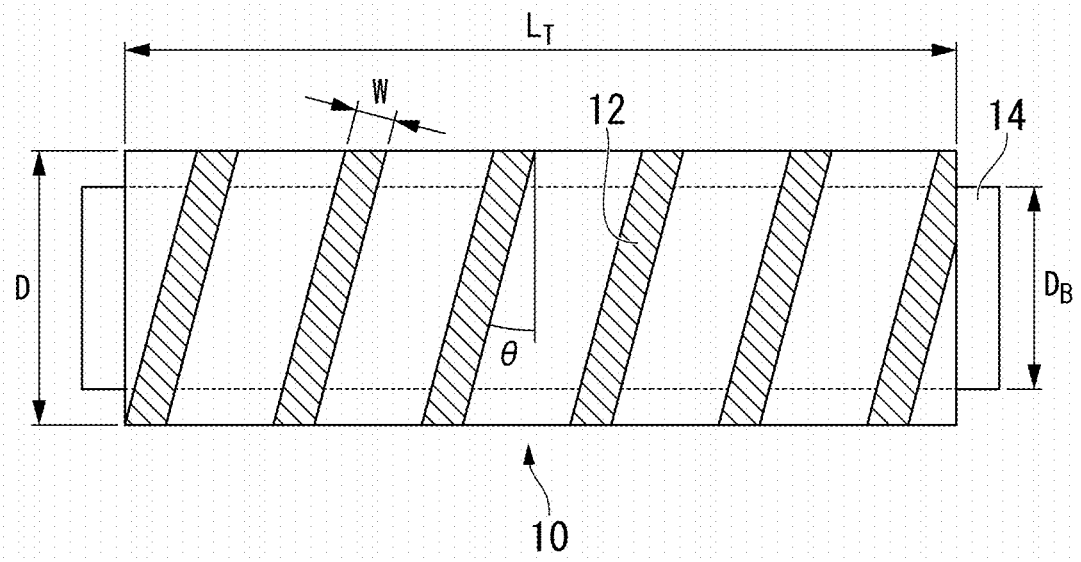
FIG. 1 is a schematic diagram showing the configuration of a fiber package.

FIG. 1 is a schematic diagram showing a fiber package 10 of the present embodiment, as viewed from a direction perpendicular to the axis of rotation of a bobbin 14. As shown in FIG. 1, the fiber package 10 is a square end type fiber package in which a fiber bundle 12 having a width W is traverse wound on a bobbin 14.

Figure 3:
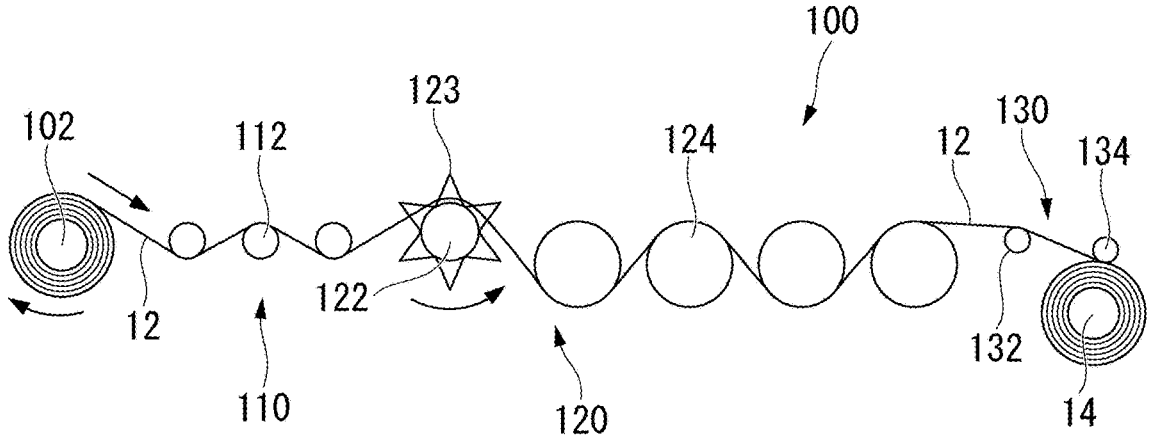
FIG. 3 is a conceptual diagram showing a fiber package producing apparatus.

The fiber package 10 can be produced using, without limitation, a producing apparatus 100, a conceptual diagram of which is shown in FIG. 3.

The producing apparatus 100 includes a spreader 110 for deforming a fiber bundle 12 to be flattened (or widening the fiber bundle 12 to make it flatter), a splitter 120 for partially splitting the fiber bundle 12, and a winder 130 for winding the fiber bundle 12 around a bobbin 14.

The spreader 110 includes spreader bars 112. The spreader bars 112 may be heated or may be reciprocatingly moved in a direction perpendicular to the traveling direction of the fiber bundle 12, and known technologies can be referred to for the mechanism for that purpose. The fiber bundle 12 supplied from a supply bobbin 102 and traveling in the fiber direction is flattened or widened by being rubbed against the spreader bars 112 and is made to have a thickness of about 0.05 to 0.2 mm.

When the fiber bundle 12 supplied from the supply bobbin 102 is already sufficiently flat, the spreader 110 can be omitted.

For example, when the width is 50 or more times the thickness, the fiber bundle 12 may be considered to be sufficiently flat.

The splitter 120 includes a rotary blade 122 for forming slits in the fiber bundle 12, and a plurality of godet rolls 124 for controlling the traveling speed of the fiber bundle 12.

The axis of rotation of the rotary blade 122 is parallel to the width direction of the fiber bundle 12. A plurality of blades 123 are provided on the outer circumference of the rotary blade 122 at regular intervals in the circumferential direction, such that slits of a constant length are intermittently formed with a constant period along the fiber direction (longitudinal direction) of the fiber bundle 12.

The length of the slits formed in the fiber bundle 12 by the splitter 120 can be controlled by regulating the circumferential speed of the rotary blade 122 and the traveling speed of the fiber bundle 12.

Figure 2A:
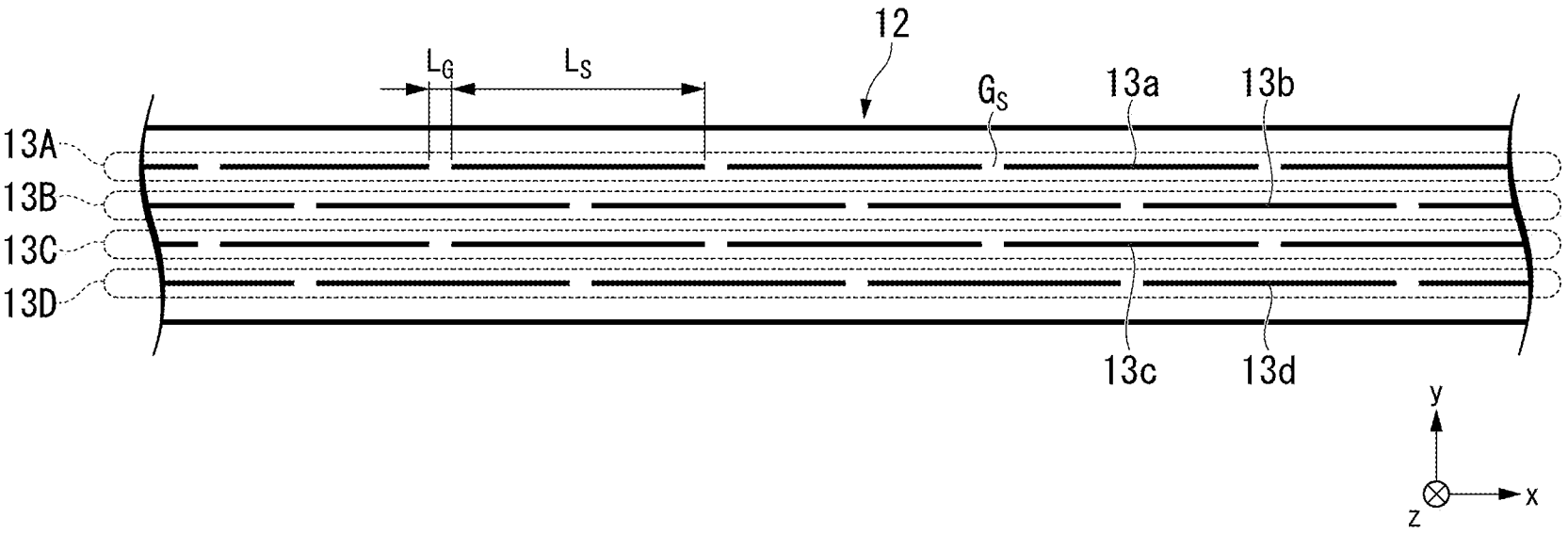
FIG. 2A is a schematic diagram showing a partially split carbon fiber bundle and is a plan view.
Figure 2B:
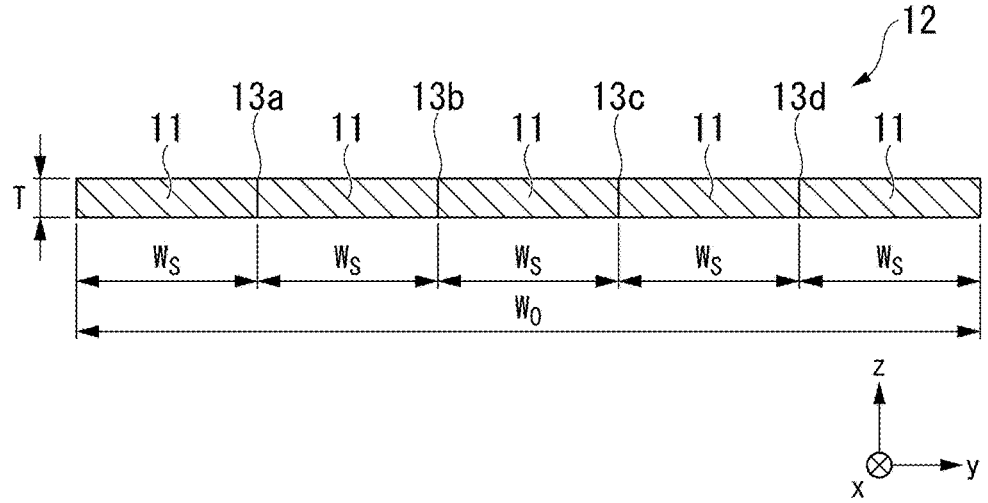
FIG. 2B is a schematic diagram showing a partially split carbon fiber bundle and is a cross-sectional view showing when the carbon fiber bundle is cut by a plane perpendicular to the fiber direction.

A partially split fiber bundle 12 having a width Wo, which is obtained when using a splitter 120 in which four rotary blades 122 are lined up in the width direction of the traveling fiber bundle, is shown in FIG. 2A and FIG. 2B. For convenience, when the fiber direction of the fiber bundle is designated as the x direction, the width direction is designated as the y direction, and the thickness direction is designated as the z direction, FIG. 2A is a plan view of the fiber bundle 12 as viewed from the z direction, and FIG. 2B shows a cross section of the fiber bundle 12 perpendicular to the x direction.

As shown in FIG. 2A, in the fiber bundle 12, four slit rows, namely, a first slit row 13A, a second slit row 13B, a third slit row 13C, and a fourth slit row 13D, are formed.

The first slit row 13A is composed of a plurality of first slits 13*a* lined up in the x direction.

The second slit row 13B is composed of a plurality of second slits 13*b* lined up in the x direction.

The third slit row 13C is composed of a plurality of third slits 13*c* lined up in the x direction.

The fourth slit row 13D is composed of a plurality of fourth slits 13*d* lined up in the x direction.

Since these four slit rows are formed by different rotary blades, their positions in the y direction are different.

The slit length $L_S$ and the gap length between slits $L_G$ are constant within any slit row and are common to all different slit rows.

The ratio of the slit length $L_S$ to the sum of the slit length $L_S$ and the gap length between slits $L_G$, $L_S/(L_S+L_G)$, is usually 90% or more, and preferably 95% or more, and may be, for example, 99%. Therefore, the fiber bundle 12 is split, in most parts, into five sub-bundles 11 as shown in FIG. 2B.

The positions of the first slit row 13A, the second slit row 13B, the third slit row 13C, and the fourth slit row 13D in the y direction are set such that the five sub-bundles 11 have roughly the same width $W_S$.

The slit length $L_S$ is preferably 25 mm or more, more preferably more than 50 mm, and even more preferably more than 500 mm. This is because when the fiber bundle 12 is chopped into chopped fiber bundles for use in a sheet molding compound, the fiber length of the chopped fiber bundles are usually about 25 to 50 mm. As the slit length $L_S$ increases, more chopped fiber bundles having a bundle size equal to or smaller than that of the sub-bundle 11 are obtained.

The slit length $L_S$ may be, for example, more than 25 mm and 50 mm or less, more than 50 mm and 100 mm or less, more than 100 mm and 200 mm or less, more than 200 mm and 500 mm or less, more than 500 mm and 1000 mm or less, more than 1000 mm and 1500 mm or less, more than 1500 mm and 2000 mm or less, or more than 2000 mm and 3000 mm or less.

The gap length between slits $L_G$ is, for example, 5 to 10 mm, and may be shorter than this range.

As shown in FIG. 2A, the positions in the x direction of the gaps $G_S$ between the slits are shifted between the first slit row 13A and the second slit row 13B. The same also applies to the positions between the second slit row 13B and the third slit row 13C, and between the third slit row 13C and the fourth slit row 13D.

As such, by shifting the positions in the x direction of the gaps $G_S$ between the slits between adjacent slit rows, portions where the fiber bundle 12 is not split at all can be eliminated. However, such a configuration is not essential, and the positions in the x direction of the gaps $G_S$ between the slits may be the same between adjacent slit rows.

The number of sub-bundles produced by partially splitting the fiber bundle 12 with the splitter 120 can be appropriately determined by the number of rotary blades provided in the splitter 120. The number of the sub-bundles is preferably 3 or more, more preferably 5 or more and may also be 10 or more.

The number of filaments in a sub-bundle formed by partial splitting of the fiber bundle 12 is preferably 5000 or less, and more preferably 3000 or less and may also be 2000 or less.

As shown in FIG. 3, the winder 130 includes a traverse guide 132 and a press roll 134 that presses the fiber bundle 12 wound around the bobbin 14.

The fiber package 10 is obtained by traverse winding the fiber bundle 12 on the bobbin 14 using the winder 130.

Figure 4:
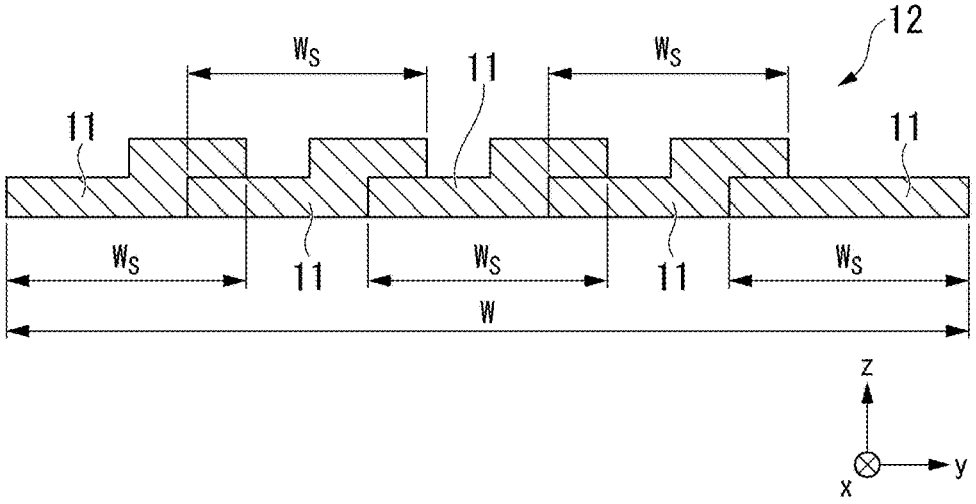
FIG. 4 is a cross-sectional view of a carbon fiber bundle wound around a bobbin such that sub-bundles overlap each other, the cross-sectional view showing that the carbon fiber bundle is cut by a plane perpendicular to the fiber direction.

The width W of the fiber bundle 12 in the fiber package 10 is smaller than the total sum of the widths $W_S$ of the sub-bundles 11. This means that, as shown in FIG. 4, the fiber bundle 12 is wound around the bobbin 14 so as to cause the sub-bundles 11 to overlap each other. The mode of overlapping between the sub-bundles 11 shown in FIG. 4 is an example, and the sub-bundles 11 may overlap each other in another mode.

When the sub-bundles 11 are caused to overlap each other, since biting between the fiber bundles 12 is not likely to occur, unwindability of the fiber bundles 12 is improved during the use of the fiber package 10.

In order to wind the fiber bundle 12 around the bobbin 14 so as to cause the sub-bundles 11 to overlap each other, the width W of the fiber bundle 12 when wound around the bobbin 14 may be made narrower than the total sum of the widths $W_S$ of the sub-bundles 11, by regulating the groove width of one or more grooved rolls through which the fiber bundle 12 passes from the point of being split to the point of being wound around the bobbin 14 via the traverse guide 132. The width W of the fiber bundle 12 is narrowed by passing through a grooved roll having a narrow groove width.

In the fiber package 10, the width W of the fiber bundle 12 is preferably 90% or less, and more preferably 86% or less, of the total sum of the widths $W_S$ of the sub-bundles 11. Due to the deformation to which the fiber bundle is subjected until being wound around the bobbin, the width $W_S$ of the sub-bundle 11 may not be the same as that immediately after splitting of the fiber bundle 12.

In the fiber package 10, the width W of the fiber bundle 12 is not limited, but is, for example, 2 to 15 mm and may be 3 to 12 mm.

When the fiber bundle 12 is traverse wound around the bobbin 14, the lead angle at the winding start is preferably 5° to 30°, and the lead angle at the winding end is preferably 2° to 17°.

In a traverse winding, there is a relationship represented by the following formula between a winding ratio $R_W$, a traverse length Li, a winding diameter D, and a lead angle θ.

$$R_W = 2L_T/(\pi D \tan \theta)$$

As shown in FIG. 1, the traverse length Li is the stroke of the traverse guide that reciprocatingly moves along the axial direction of the bobbin. The winding ratio $R_W$ represents how many rotations the bobbin makes during one round trip of the traverse guide. This may be rephrased as the number of turns per traverse cycle. The winding diameter D is the bobbin diameter $D_B$ at the winding start.

During the production of the fiber package 10, the fiber bundle 12 is wound around the bobbin 14 at a constant winding ratio.

It is known generally that, when a thread is wound around a bobbin with a constant winding ratio, if the winding ratio is an integer, so-called ribbon winding in which the thread is wound at the same position on the bobbin in all traverse cycles occurs and unwindability is deteriorated.

Also when the fraction after the decimal point of the winding ratio is a multiple of 1/n (n is an integer of 2 or more), since the thread is wound at the same position on the bobbin in every n cycles of traversing, there is a problem in the unwindability similarly to the case where the winding ratio is an integer, especially when n is small.

Thus, preferably, the fraction after the decimal point of the winding ratio is set such that the positions of the center lines are surely shifted between sections of the fiber bundle 12 wound around the bobbin 14 in consecutive traverse cycles that are not separated by 5 cycles or more. Here, the center line is a center line of the fiber bundle, which is a line that extends in the longitudinal direction of the fiber bundle and divides the fiber bundle into two equal parts when viewed from the thickness direction (the same applies in the following).

Actually, even if the positions of the center lines are shifted as such between sections of the fiber bundle 12 wound in different traverse cycles, when the shift width is excessively small compared to the width W of the fiber bundle 12, the unwindability may be deteriorated.

Thus, more preferably, between sections of the fiber bundle 12 wound around the bobbin 14 in consecutive traverse cycles that are not separated by 5 cycles or more, the positions of the center lines should be shifted at a shift width of at least 0.8 or more times, preferably 1.0 or more times, and more preferably 1.3 or more times the width W of the fiber bundle 12. The shift width as used herein refers to a shift width when a direction orthogonal to the center line of the fiber bundle 12 is designated as a shift direction.

To give a supplementary explanation of the traverse cycle, when an Nth traverse cycle from the winding start is designated as the Nth traverse cycle, the traverse cycle that is separated from the Nth traverse cycle by 5 cycles is the (N−5)th traverse cycle and the (N+5)th traverse cycle.

The total number of filaments of the fiber bundle 12 is not limited, but is, for example, 6000 filaments or more and may be 12000 to 15000 filaments, 15000 to 24000 filaments, 24000 to 40000 filaments, 40000 to 60000 filaments, or the like.

The bobbin 14 is not particularly limited and is, for example, a paper tube.

The diameter $D_B$ of the bobbin 14 can be appropriately set and can be, for example, 50 to 150 mm.

The fiber package 10 can also be used after removing the bobbin 14.

2. Experimental Results

The results of the experiments conducted by the present inventors are described below.

[Experiment 1]

A square end type fiber package was produced by preparing a flat carbon fiber bundle having a total number of filaments of 15000, an initial width of 8 mm, and a thickness of 0.1 mm, partially splitting the flat carbon fiber bundle, and then winding the split carbon fiber bundle around a paper bobbin having a diameter of 82 mm and a length of 280 mm at a traverse length of 254 mm. Widening by a spreader was not performed.

A splitter with four rotary blades was used for the partial splitting of the carbon fiber bundle. By forming four slit rows each having a slit length of 1000 mm and a gap length between slits of 5 mm, the carbon fiber bundle was split into five sub-bundles each having a width of 1.6 mm, which were partially connected to each other. The positions of the gap between slits in the fiber direction were the same among all the slit rows.

With regard to the winding, the lead angle at the winding start was 9.9°, the lead angle at the winding end was 5°, the winding ratio was 11.30, and the winding amount was 5.0 kg. Under these conditions, the shift widths of the positions of the center lines between sections of the carbon fiber bundle wound in consecutive traverse cycles that were not separated by 5 cycles or more were 10 mm or more.

By regulating the groove width of the grooved roll through which the carbon fiber bundle passed after the splitting treatment, the width of the carbon fiber bundle to be wound around the bobbin was 6 mm, which was 75% of the total sum of the widths of the sub-bundles. Therefore, the shift widths were at least 1.7 times the width of the carbon fiber bundle.

[Experiment 2]

A fiber package was produced in the same manner as in Experiment 1, except that the following changes were made.

- The carbon fiber bundle that were initially prepared had a total number of filaments of 50000 filaments, an initial width of 14 mm, and a thickness of 0.2 mm
- A splitter with 16 rotary blades was used for the partial splitting of the carbon fiber bundle. By providing 16 slit rows each having a slit length of 700 mm and a gap length between slits of 5 mm, the carbon fiber bundle was split into 17 sub-bundles each having a width of 0.8 mm, which were partially connected to each other.
- The lead angle at the winding end was 3°, and the winding amount was 9.5 kg. The shift widths of the positions of the center lines between sections of the carbon fiber bundle wound in consecutive traverse cycles that were not separated by 5 cycles or more were 10 mm or more, similarly to Experiment 1.
- The width of the carbon fiber bundle to be wound around the bobbin was 12 mm, which was 86% of the total sum of the widths of the sub-bundles. Therefore, the shift widths were at least 0.8 times the width of the carbon fiber bundle.

[Experiment 3]

A fiber package was produced in the same manner as in Experiment 1, except that the following changes were made.

- The lead angle at the winding start was 14°, the lead angle at the winding end was 10°, and the winding ratio was 7.91. Under these conditions, the shift widths of the positions of the center lines between sections of the carbon fiber bundle wound in consecutive traverse cycles that were not separated by 5 cycles or more were 4 mm or more.
- The width of the carbon fiber bundle to be wound around the bobbin was 3 mm, which was 38% of the total sum of the widths of the sub-bundles. Therefore, the shift widths were at least 1.3 times the width of the carbon fiber bundle.

[Experiment 4]

A fiber package was produced in the same manner as in Experiment 3, except that the following changes were made.

- The width of the carbon fiber bundle to be wound around the bobbin was 6 mm, which was 75% of the total sum of the widths of the sub-bundles. Therefore, the shift widths of the positions of the center lines between sections of the carbon fiber bundle wound in consecutive traverse cycles that were not separated by 5 cycles or more were at least 0.7 times the width of the carbon fiber bundle.

[Experiment 5]

A fiber package was produced in the same manner as in Experiment 1, except that the following changes were made.

- The width of the carbon fiber bundle to be wound around the bobbin was 8 mm, which was the same as the total sum of the widths of the sub-bundles. Therefore, the shift widths of the positions of the center lines between sections of the carbon fiber bundle wound in consecutive traverse cycles that were not separated by 5 cycles or more were at least 1.3 times the width of the carbon fiber bundle.

[Experiment 6]

A fiber package was produced in the same manner as in Experiment 2, except that the following changes were made.

- The lead angle at the winding start was 14°, the lead angle at the winding end was 10°, the winding ratio was 7.91, and the winding amount was 9.5 kg. Under these conditions, the shift widths of the positions of the center lines between sections of the carbon fiber bundle wound in consecutive traverse cycles that were not separated by 5 cycles or more were 4 mm or more.
- The width of the carbon fiber bundle to be wound around the bobbin was 12 mm, which was 86% of the total sum of the widths of the sub-bundles. Therefore, the shift widths of the positions of the center lines between sections of the carbon fiber bundle wound in consecutive traverse cycles that were not separated by 5 cycles or more were at least 0.3 times the width of the carbon fiber bundle.

The unwindability observed when the bobbin was pulled out from the fiber package produced in each of the above-described experiments and the carbon fiber bundle was pulled out from the inside of the package was evaluated according to the following criteria.

O: The carbon fiber bundle did not get entangled or broken.

X: There was a problem in that the carbon fiber bundle was entangled or broken.

The conditions used in each of the above-described experiments and the evaluation results for the fiber packages are shown in Table 1.

TABLE 1

| | | Experiment 1 | Experiment 2 | Experiment 3 | Experiment 4 | Experiment 5 | Experiment 6 |
|---|---|---|---|---|---|---|---|
| Supplied carbon fiber bundle | Total number of filaments | 15000 | 50000 | 15000 | 15000 | 15000 | 50000 |
| | Initial width [mm] | 8 | 14 | 8 | 8 | 8 | 14 |
| Split | Number of sub-bundles | 5 | 17 | 5 | 5 | 5 | 17 |
| | Width of sub-bundle [mm] | 1.6 | 0.8 | 1.6 | 1.6 | 1.6 | 0.8 |
| Fiber package | Width of carbon fiber bundle [mm] | 6 | 12 | 3 | 6 | 8 | 12 |
| | Lead angle at winding start [°] | 9.9 | 9.9 | 14 | 14 | 9.9 | 14 |
| | Lead angle at winding end [°] | 5 | 3 | 10 | 10 | 5 | 10 |
| | Winding ratio | 11.30 | 11.30 | 7.91 | 7.91 | 11.30 | 7.91 |
| | Traverse length [mm] | 254 | 254 | 254 | 254 | 254 | 254 |
| | Outer diameter of bobbin [mm] | 82 | 82 | 82 | 82 | 82 | 82 |
| | Winding amount [kg] | 5.0 | 9.5 | 5.0 | 5.0 | 5.0 | 9.5 |
| | Unwindability | ○ | ○ | ○ | X | X | X |

With regard to the fiber package produced in Experiment 5, the reason why the unwindability of the carbon fiber bundle was not favorable is considered to be that the carbon fiber bundle was wound around the bobbin in a state in which the sub-bundles did not overlap each other.

With regard to the fiber packages produced in Experiments 4 and 6, the reason why the unwindability of the carbon fiber bundle was not favorable is considered to be that the shift widths of the positions of the center lines between sections of the carbon fiber bundle wound in consecutive traverse cycles that were not separated by 5 cycles or more were excessively small in some parts as compared to the width of the carbon fiber bundle.

REFERENCE SIGNS LIST

10: Fiber package
11: Sub-bundle
12: Fiber bundle
13A: First slit row
13*a*: First slit
13B: Second slit row
13*b*: Second slit
13C: Third slit row
13*c*: Third slit
13D: Fourth slit row
13*d*: Fourth slit
14: Bobbin

What is claimed is:

1. A fiber package, which is a square end type fiber package formed by traverse winding a carbon fiber bundle around a bobbin, wherein the carbon fiber bundle is partially split into sub-bundles in a longitudinal direction of the carbon fiber bundle and is wound around the bobbin so as to cause the sub-bundles to overlap each other, a width of the carbon fiber bundle is smaller than a total sum of widths of the sub-bundles, the carbon fiber bundle has more than one slit rows, and each of the slit rows includes a plurality of slits in the longitudinal direction, and the plurality of slits satisfies $L_S/(L_S+L_G)$ of 90% or more, in which $L_S$ is a slit length of each of the plurality of slits, and $L_G$ is a gap length between the plurality of slits adjacent to each other.

2. The fiber package according to claim 1, wherein the width of the carbon fiber bundle is 90% or less of the total sum of widths of the sub-bundles.

3. The fiber package according to claim 1, wherein between sections of the carbon fiber bundle wound around the bobbin in consecutive traverse cycles that are not separated by 5 cycles or more, the positions of center lines are shifted at least by a shift width of 0.8 or more times the width of the carbon fiber bundle.

4. The fiber package according to claim 3, wherein between sections of the carbon fiber bundle wound around the bobbin in consecutive traverse cycles that are not separated by 5 cycles or more, the positions of center lines are shifted at least by a shift width of 1.0 or more times the width of the carbon fiber bundle.

5. The fiber package according to claim 4, wherein between sections of the carbon fiber bundle wound around the bobbin in consecutive traverse cycles that are not separated by 5 cycles or more, the positions of center lines are shifted at least by a shift width of 1.3 or more times the width of the carbon fiber bundle.

6. The fiber package according to claim 1, wherein the carbon fiber bundle is partially split into three or more sub-bundles.

7. The fiber package according to claim 1, wherein the number of filaments of the sub-bundles is 5000 or less.

8. The fiber package according to claim 1, wherein the total number of filaments of the carbon fiber bundle is 12000 or more.

9. The fiber package according to claim 1, wherein the width of the carbon fiber bundle is 86% or less of the total sum of widths of the sub-bundles.

10. The fiber package according to claim 1, wherein the traverse winding has a relationship represented by formula below:

$$R_w=2L_T/(\pi D \tan \theta)$$

wherein Rw is a winding ratio,

Lt is a traverse length,

D is a winding diameter, and

θ is a lead angle.

11. A method for producing the fiber package according to claim 1, the method comprising:

partially splitting the carbon fiber bundle into the sub-bundles; and winding the carbon fiber bundle that has been partially split into the sub-bundles around the bobbin, wherein in the winding, the carbon fiber bundle is wound around the bobbin such that the width of the carbon fiber bundle is smaller than the total sum of widths of the sub-bundles.

12. A method for producing the fiber package according to claim 1, the method comprising:

partially splitting the carbon fiber bundle into the sub-bundles; and winding the carbon fiber bundle that has been partially split into the sub-bundles around the bobbin, wherein in the winding, the carbon fiber bundle is wound around the bobbin so as to cause the sub-bundles to overlap each other.

13. The method according to claim 10, wherein in the winding, the carbon fiber bundle is wound around the bobbin such that the width of the carbon fiber bundle is 90% or less of the total sum of the widths of the sub-bundles.

14. The method according to claim 10, wherein in the winding, between sections of the carbon fiber bundle wound around the bobbin in consecutive traverse cycles that are not separated by 5 cycles or more, the positions of center lines are shifted at least by a shift width of 0.8 or more times the width of the carbon fiber bundle.

15. The method according to claim 13, wherein in the winding, between sections of the carbon fiber bundle wound around the bobbin in consecutive traverse cycles that are not separated by 5 cycles or more, the positions of center lines are shifted at least by a shift width of 1.0 or more times the width of the carbon fiber bundle.

16. The method according to claim 14, wherein in the winding, between sections of the carbon fiber bundle wound around the bobbin in consecutive traverse cycles that are not separated by 5 cycles or more, the positions of center lines are shifted at least by a shift width of 1.3 or more times the width of the carbon fiber bundle.

17. The method according to claim 10, wherein in the splitting step, the carbon fiber bundle is partially split into three or more sub-bundles.

18. The method according to claim 10, wherein the number of filaments of the sub-bundle is 5000 or less.

19. The method according to claim 10, wherein the total number of filaments of the carbon fiber bundle is 12000 or more.

* * * * *